United States Patent [19]

Kim

[11] Patent Number: 4,823,558

[45] Date of Patent: Apr. 25, 1989

[54] PLASTIC PAN ASSEMBLY FOR USE IN AIR CONDITIONERS AND REFRIGERATORS

[76] Inventor: Il Yoo Kim, 779 Audubon Ave. B-7, Alexandria, Va. 22306

[21] Appl. No.: 212,699

[22] Filed: Jun. 28, 1988

[51] Int. Cl.[4] ..... F25D 21/00

[52] U.S. Cl. ..... 62/272; 62/285; 62/291

[58] Field of Search ..... 62/272, 285, 291

[56] References Cited

U.S. PATENT DOCUMENTS 4,597,269 7/1986 Kim ..... 62/286

*Primary Examiner*—Lloyd L. King

*Attorney, Agent, or Firm*—Birch, Stewart, Kolasch & Birch

[57] ABSTRACT

An improved primary pan for use in an air conditioning system which includes a C-shaped plastic pan having a raised portion or a rail disposed on the outside surface of the bottom thereof, a channeled supporting bracket having a plurality of elongated apertures for engaging the raised portion of the rail of the plastic pan, and a pair of fan covers having a channel disposed on the outside surface of the top and a circumferential raised portion disposed around a lower outlet thereof for effectively mounting to bracket and separating from the supporting bracket to the plastic pan with only two pairs of screws.

7 Claims, 2 Drawing Sheets

PLASTIC PAN ASSEMBLY FOR USE IN AIR CONDITIONERS AND REFRIGERATORS

BACKGROUND OF THE INVENTION

1. Field of the Invention

The present invention relates to a primary plastic pan assembly for use in conjunction with air conditioning installations and refrigeration systems, and more particularly to a plastic primary pan assembled with a supporting bracket which is mounted to a motor and a fan cover.

2. Description of the Prior Art

Primary pans are generally known to be utilized with air conditioning systems. Conventional devices utilize a primary pan made of steel which is directly mounted to a fan cover and a motor. However, these devices suffer from a number of problems such as, for example, the problem that metallic primary pans eventually become rusted and plug up outlets for draining water from the pan. Further, it is difficult for the pan to support the air condition system such as the motor and the pan cover, because of the additional weight caused by the metal pan, so that the motor cannot be used for a long time. It is also very difficult for the primary pans to separate from such devices because the structure is very complicated and the device has a heavy weight.

In order to avoid such problems, U.S. Pat. No. 4,597269, issued to the present inventor, discloses a plastic pan adapted to be mounted to the motor of an air conditioning system which includes a primary pan, a support bracket, height-adjustable brackets, and a motor mount bracket whereby the plastic pan avoids the plugging up of the outlet. However, this primary pan exhibits some problems with regard to convenient and reliable assembling and requires a lot of bolts for installation.

SUMMARY OF THE INVENTION

Accordingly, it is an object of the present invention to provide an improved plastic pan assembly for use in air conditioning systems and refrigerators.

Another object of the present invention is to provide a plastic primary pan which is structured for draining condensate water through an outlet while avoiding the plugging up of the outlet.

Still another object of the present invention is to provide an air conditioning system which includes an assembly for easily mounting a primary pan to a supporting bracket which has a plurality of elongated apertures and which is mounted to a motor and fan covers.

A further object of the present invention is to provide an improved primary pan for smoothly mounting to and easily separating from an air conditioning system which includes a C-shaped plastic pan having a raised portion or a rail disposed on the outside surface of the bottom thereof, a channeled supporting bracket having a plurality of elongated apertures for engaging into the raised portion of the rail of the plastic pan, and a pair of fan covers having an elongated slot disposed on the outside surface of the top and a circumferential raised portion disposed around a lower outlet thereof for effectively mounting the fan covers to the plastic pan with only two pairs of screws.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a plastic primary pan assembly for use in conjunction with an air conditioning system, wherein a channeled supporting bracket is utilized to tightly engage and effectively support a plastic pan, the channeled supporting bracket having a plurality of elongated apertures being mounted on a motor and a fan cover, whereby the plastic primary pan assembly can be easily associated with and separate from the air conditioning system and easily adjusted to incline the plastic primary pan for drawing condensate water through an outlet disposed in the plastic primary pan.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
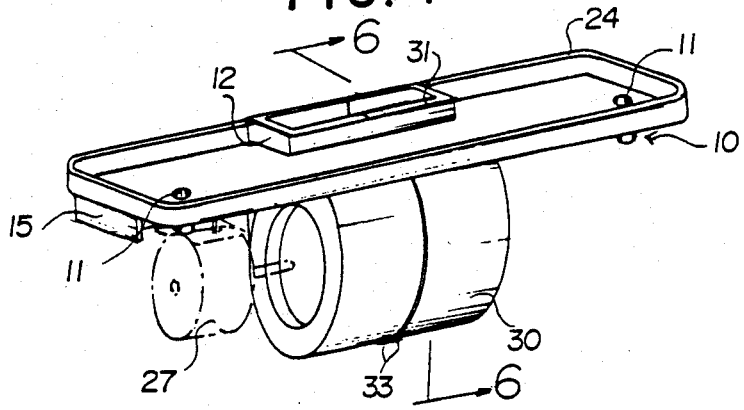
FIG. 1 is a perspective view of a plastic primary pan assembly with its associated support element.
Figure 2:
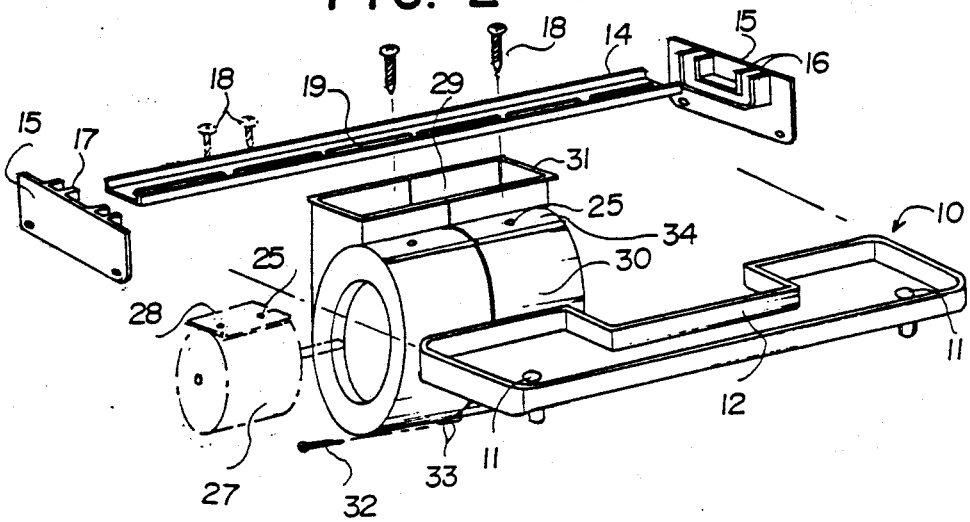
FIG. 2 is an exploded perspective view of showing basic components of a plastic primary assembly of the present invention.

Referring now in detail to the drawings for the purpose of illustrating preferred embodiments of the present invention, the plastic primary pan assembly as shown in FIG. 1 and 2 includes a plastic primary pan 10, a channeled supporting bracket 14 which is mounted to a motor 27 and a pair of fan covers 30.

Figure 4:
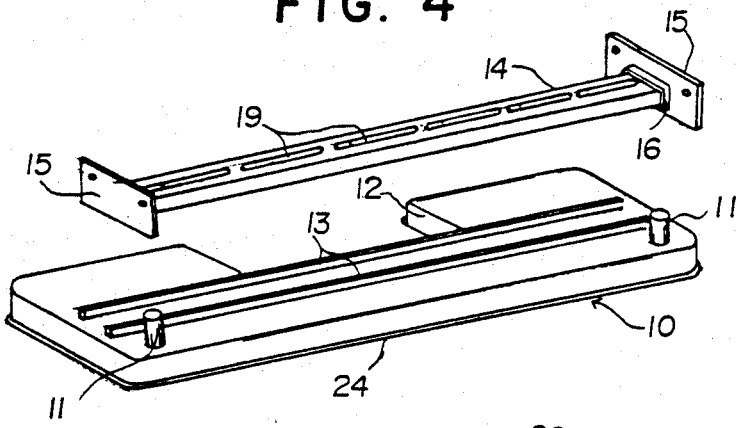
FIG. 4 is an exploded perspective view of the plastic primary pan and a supporting bracket of the present invention.

As shown in FIG. 4, the plastic primary pan 10 is provided with two drain pipes 11 disposed in both end portions thereof for draining condensate water. Also, the plastic primary pan 10 contains a rail 13 disposed on the outside surface of the bottom thereof and a C-shaped circumferential portion 12 disposed on one side of the rectangular configuration of the primary pan 10. The channeled supporting bracket 14 for receiving the rail 13 contains a plurality of elongated apertures 19 for adjustably receiving screws 18. The channeled supporting bracket 14 is provided with a pair of engaging plates 15 for supporting and engaging to a housing of the air conditioning system (not shown). Since the engaging plates 15 have U-shaped channel 17 defined by U-shaped rail 16, respectively, the channeled supporting bracket 14 can be effectively engaged in the U-shaped channel 17 of the pair of plates 15 (FIG. 2).

Figure 3:
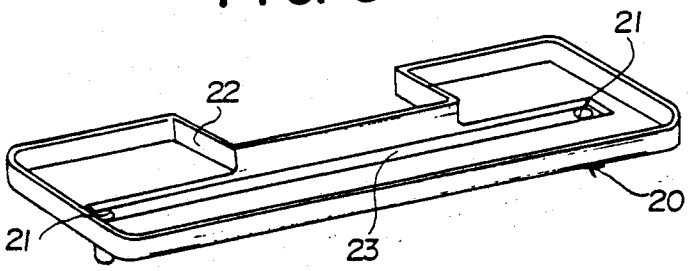
FIG. 3 is a perspective view of another embodiment of the plastic primary pan of the present invention.
Figure 5:
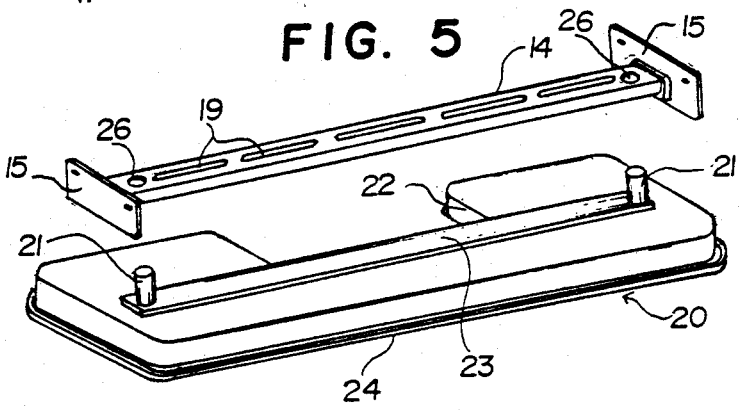
FIG. 5 is an exploded perspective view of the another embodiment of primary pan and supporting bracket of the present invention.

Referring in detail to FIGS. 3 and 5, there is illustrated an additional embodiment of the plastic primary pan 20 for use in an air conditioning system in accordance with the present invention. The plastic primary pan 20 contains an elongated recess 23 disposed in the center portion thereof and two drain pipes 21 for collecting and draining the condensate water. Also, the plastic primary pan 20 is provided with an elongated raised portion 23 disposed on the outside surface of the bottom thereof for effectively engaging the channeled supporting bracket 14 and a C-shaped conferential portion 22 disposed at one side of the rectangular configuration of the plastic primary pan. The channeled supporting bracket 14 is provided with holes 26 disposed in end portions for receiving the drain pipes 21 of the plastic primary pan 20 (FIG. 5).

Figure 6:
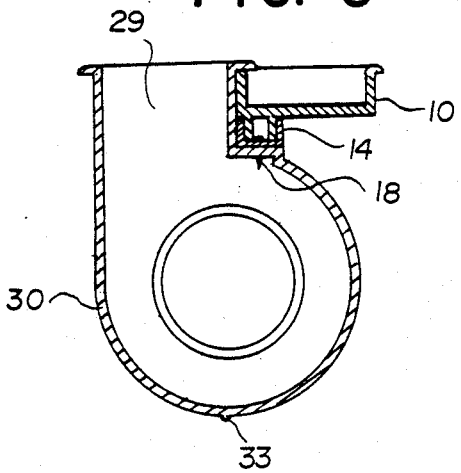
FIG. 6 is a sectional view of FIG. 1 showing the attachment of a pan cover to the plastic primary pan and supporting bracket of the present invention.

As shown in FIGS. 1, 2 and 6, the pair of fan covers 30 each contain a lower outlet 29 which has a circumferential raised portion 31 for being adapted to suspend to the C-shaped circumferential portion 12 of the plastic primary pan 10. The fan covers 30 have an elongated slots 34 disposed on the top surface thereof for receiving the supporting bracket 14 by screw 18 through apertures 25 of the pan covers 30 (FIG. 6). Also, the fan covers have pin engagements 33, respectively, for receiving a pin 32 to combine them together. The motor 27 is provided with a motor plate 28 for being mounted to the supporting bracket 14 by screws 18 through the apertures 25 of the motor plate 25. Accordingly, since the motor 27 is mounted to the straight supporting bracket 14, it is believed that the motor 27 can be maintained for a long time when compared with the motor utilized the conventional air conditioning devices.

In assembly, after the fan covers 30 containing a fan (not shown) are combined together with the pin 32 through the engagements 33, the channeled supporting bracket 14 is engaged with the combined fan covers 30 by screws 18 through the elongated slots 34 and the apertures 25 of the fan covers 30. And the motor 27 is mounted to the supporting bracket 14 by screws 18 through the elongated apertures 19 of the supporting bracket 14 and the apertures 25 of the motor plate 28. Thereafter, the plastic primary pan 10 or 20 is engaged with and separate from the supporting bracket 14 containing the motor 27 and the fan covers 39 by inserting the rail 13 of the pan 10 or the raised portion 23 of the pan 20 into the elongated slots 34 of the fan covers 30. The circumferential raised portion 31 of the fan covers 30 are engaged with a top surface 24 of the C-shaped conferential portion of the pan 10 or 20. Finally, the engaging plates 15 are attached to both ends of the channeled supporting bracket 14 through the U-shaped channel 17 of the engaging plates 15. Thereafter, the engaging plates 15 are attached to the walls of the housing of the air conditioning system with the inclination for easily drawing condensate water through one of the drain pipes 11 or 21.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A primary pan assembly adapted to be mounted to the motor of an air conditioning system which comprises:

a plastic primary pan provided with a drainage hole disposed on at least one side thereof, a rail disposed on the outside of the bottom thereof, and a C-shaped circumferential portion on one side thereof, a channeled supporting bracket having a plurality of elongated apertures disposed in the center thereof for receiving said rail of said primary pan, a motor mounted to said channeled supporting bracket by screws through said elongated apertures, and a pair of fan covers having elongated slots disposed on the top surface thereof for receiving said supporting bracket, and a circumferential raised portion disposed around a lower outlet thereof for suspending said fan covers on said C-shaped circumferential portion of the plastic primary pan, whereby the primary pan assembly can be mounted to housing walls of the air conditioning system at an inclination for easily draining the condensate water through the drainage hole and can be easily installed without a large number of screws and the primary pan can be smoothly mounted to and easily separated from the channeled supporting bracket.

2. The primary pan assembly of claim 1, wherein the drainage hole extends to a drain pipe for inserting into a hole of the channeled supporting bracket.

3. The primary pan assembly of claim 1, wherein the channeled supporting bracket is provided with a pair of engaging plates which have U-shaped channel formed thereon for receiving said channeled supporting bracket, said engaging plates being installable onto the housing wall of the air conditioning system.

4. The primary pan assembly of claim 1, wherein the plastic primary pan is provided with an elongated recess disposed in the center thereof and at least a drainage hole disposed on an end portion of said elongated recess for collecting and draining water through the drainage hole.

5. The primary pan assembly of claim 1, wherein the channeled supporting bracket is made of aluminum.

6. The primary pan assembly of claim 1, wherein the channeled supporting bracket is made of steel.

7. The primary pan assembly of claim 1, wherein the channeled supporting bracket is made of plastic.

* * * * *